US009442451B2

(12) United States Patent
Yamauchi et al.

(10) Patent No.: US 9,442,451 B2
(45) Date of Patent: Sep. 13, 2016

(54) ELECTROCONDUCTIVE MEMBER FOR ELECTROPHOTOGRAPHY, PROCESS CARTRIDGE, AND ELECTROPHOTOGRAPHIC IMAGE-FORMING APPARATUS

(71) Applicant: CANON KABUSHIKI KAISHA, Tokyo (JP)

(72) Inventors: Kazuhiro Yamauchi, Suntou-gun (JP); Satoru Nishioka, Suntou-gun (JP); Kenichi Yamauchi, Mishima (JP); Hiroki Masu, Tokyo (JP); Noriko Suzumura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/945,297

(22) Filed: Nov. 18, 2015

(65) Prior Publication Data

US 2016/0154366 A1 Jun. 2, 2016

(30) Foreign Application Priority Data

Nov. 28, 2014 (JP) ..... 2014-242406

(51) Int. Cl.
*G03G 15/00* (2006.01)
*G03G 15/02* (2006.01)
(Continued)

(52) U.S. Cl.
CPC ..... *G03G 15/75* (2013.01); *G03G 5/14704* (2013.01); *G03G 5/14708* (2013.01);
(Continued)

(58) Field of Classification Search
CPC ..... G03G 15/0233; G03G 15/1685; G03G 15/0818
See application file for complete search history.

(56) References Cited

U.S. PATENT DOCUMENTS 4,696,255 A * 9/1987 Yano ..... G03G 15/0818 399/281
5,479,243 A 12/1995 Kurokawa et al.
(Continued)

FOREIGN PATENT DOCUMENTS

EP 1 170 640 A2 1/2002
JP 6-266206 A 9/1994
JP 2004-361565 A 12/2004

OTHER PUBLICATIONS

European Search Report dated Mar. 24, 2016 in European Application No. 15196720.5.
(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

Provided is an electroconductive member for electrophotography which is suppressed in adhesion of a contaminant to a surface thereof. The electroconductive member for electrophotography includes, in this order, an electroconductive support, an electroconductive elastic layer, and a surface layer. The surface layer contains a binder resin and electroconductive fine particles having a number average particle diameter of 5.0 nm or more and 50.0 nm or less. At least part of the electroconductive fine particles are exposed from the surface layer. The surface layer has, on a surface thereof, protruded portions derived from exposed portions of the electroconductive fine particles. The surface layer has a volume resistivity of $1.0\times10^{10}$ Ωcm or more and $1.0\times10^{16}$ Ωcm or less and a universal hardness at a depth of 1 μm from the surface thereof of 1.0 N/mm$^2$ or more and 7.0 N/mm$^2$ or less.

11 Claims, 3 Drawing Sheets

(51) Int. Cl.

| | |
|---|---|
| ***G03G 15/08*** | (2006.01) |
| ***G03G 15/16*** | (2006.01) |
| ***G03G 5/147*** | (2006.01) |
| ***G03G 15/22*** | (2006.01) |

(52) U.S. Cl.
CPC ..... *G03G15/0233* (2013.01); *G03G 15/0818* (2013.01); *G03G 15/1685* (2013.01); *G03G 15/22* (2013.01); *G03G 2221/1606* (2013.01)

(56) References Cited

U.S. PATENT DOCUMENTS

2003/0232185 A1* 12/2003 Shimamura ..... G03G 15/0818 428/323
2012/0213553 A1* 8/2012 Hoshio ..... G03G 15/0233 399/176
2012/0308261 A1 12/2012 Tsuru et al.
2013/0272747 A1* 10/2013 Watanabe ..... B05D 5/00 399/168
2013/0302064 A1* 11/2013 Furukawa ..... G03G 15/0233 399/111
2014/0064792 A1 3/2014 Kawamura et al.
2014/0234764 A1* 8/2014 Aoyama ..... G03G 15/0233 430/56
2014/0334843 A1 11/2014 Taniguchi et al.
2015/0093151 A1 4/2015 Muranaka et al.
2015/0198900 A1 7/2015 Yamada et al.
2015/0198904 A1 7/2015 Kikuchi et al.
2015/0198906 A1 7/2015 Yamauchi et al.
2015/0198907 A1 7/2015 Hino et al.

OTHER PUBLICATIONS

Nishioka, et al., U.S. Appl. No. 14/943,774, filed Nov. 17, 2015.
Masu, et al., U.S. Appl. No. 14/946,768, filed Nov. 19, 2015.
Yamauchi, et al., U.S. Appl. No. 14/945,314, filed Nov. 18, 2015.

* cited by examiner

ELECTROCONDUCTIVE MEMBER FOR ELECTROPHOTOGRAPHY, PROCESS CARTRIDGE, AND ELECTROPHOTOGRAPHIC IMAGE-FORMING APPARATUS

BACKGROUND OF THE INVENTION

1. Field of the Invention

The present invention relates to an electroconductive member, a process cartridge, and an electrophotographic image-forming apparatus.

2. Description of the Related Art

In an electrophotographic apparatus, which is an image-forming apparatus employing an electrophotographic system, electroconductive members are used in various applications, for example, as electroconductive rollers, such as a charging roller, a developing roller, and a transferring roller.

When such electroconductive roller is used for a long period of time, dust of, for example, an external additive or toner remaining on a photosensitive member adheres as a contaminant to a surface of the electroconductive roller. For example, in the case of the charging roller, when the contaminant adheres to a surface of the charging roller, its resistance is locally increased at the site where the contaminant adheres, and improper charging occurs at the portion having the increased resistance. As a result, an uneven density of an image due to the contamination occurs in some cases.

In recent years, there have been demands for increases in image quality, speed, and durability of the electrophotographic apparatus. Along with the demands, a particle diameter of the toner tends to be reduced and various kinds of external additives tend to be used. As a result, an amount of the contaminant depositing on the charging member has been increased.

In addition, in recent years, a cleaner-less system (toner recycling system) has been proposed from the viewpoints of simplifying the electrophotographic apparatus and eliminating waste. This system is an electrophotographic process in which a drum cleaner serving as a cleaning unit after a transferring step is eliminated, and transfer residual toner on the photosensitive member after transfer is removed from the photosensitive member by "cleaning simultaneous with development" using a developing apparatus and is recovered and reutilized by the developing apparatus. The cleaning simultaneous with development is a method involving recovering the transfer residual toner remaining on the photosensitive member after transfer during development before proceeding to the next step through the use of a fog-removing bias (fog-removing voltage difference Vback which is a potential difference between a DC voltage to be applied to the developing apparatus and a surface potential of the photosensitive member). As compared to the case where the drum cleaner is present, in the case where a charging roller of a contact charging system is applied to the cleaner-less system, an amount of the contaminant, particularly the toner, remaining on the photosensitive member is dramatically increased, and hence the adhesion of the contaminant to the charging roller becomes a more significant problem.

As a method of reducing the adhesion of the contaminant, such as the external additive or the toner, in Japanese Patent Application Laid-Open No. H06-266206, there is proposed a technique involving coating the surface of the charging member with a fluorine compound, a silicone compound, or the like having an excellent anti-contamination property.

The present invention has been made in view of such technical background, and an object of the present invention is to provide an electroconductive member capable of suppressing adhesion of a contaminant, such as an external additive or toner, independent of use conditions and a use environment. In addition, another object of the present invention is to provide a process cartridge and an electrophotographic image-forming apparatus which are capable of stably forming high-quality electrophotographic images over a long period of time.

SUMMARY OF THE INVENTION

According to one embodiment of the present invention, there is provided an electroconductive member for electrophotography, including, in this order: an electroconductive support; an electroconductive elastic layer; and a surface layer, in which: the surface layer contains a binder resin and electroconductive fine particles which are dispersed in the binder resin and have a number average particle diameter of 5.0 nm or more and 50.0 nm or less; at least part of the electroconductive fine particles are exposed from the surface layer; the surface layer has, on a surface thereof, protruded portions derived from exposed portions of the electroconductive fine particles; the surface layer has a volume resistivity of $1.0\times10^{10}$ Ωcm or more and $1.0\times10^{16}$ Ωcm or less; and the surface layer has a universal hardness at a depth of 1 μm from the surface thereof of 1.0 $N/mm^2$ or more and 7.0 $N/mm^2$ or less.

According to another embodiment of the present invention, there is provided a process cartridge, including: an electrophotographic photosensitive member; and a charging member arranged in contact with the electrophotographic photosensitive member, the process cartridge being removably mounted onto a main body of an electrophotographic image-forming apparatus, in which the charging member includes the above-mentioned electroconductive member for electrophotography.

According to still another embodiment of the present invention, there is provided an electrophotographic image-forming apparatus, including: an electrophotographic photosensitive member; and a charging member arranged in contact with the electrophotographic photosensitive member, in which the charging member includes the above-mentioned electroconductive member for electrophotography.

Further features of the present invention will become apparent from the following description of exemplary embodiments with reference to the attached drawings.

DESCRIPTION OF THE EMBODIMENTS

Figure 1:
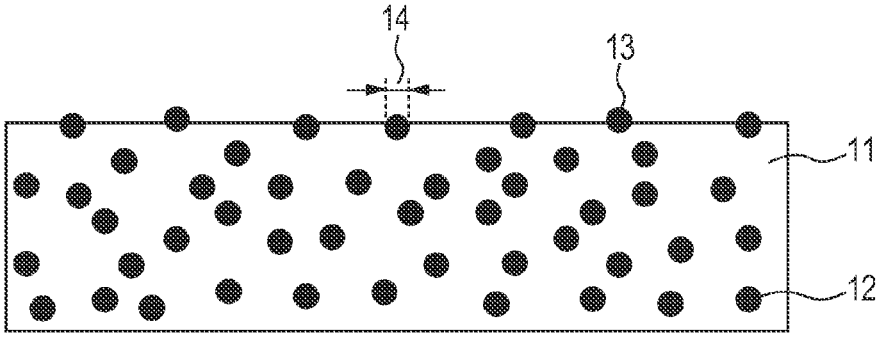
FIG. 1 is an explanatory view of the construction of a surface layer of an electroconductive member according to the present invention.

Preferred embodiments of the present invention will now be described in detail in accordance with the accompanying drawings.

A DC voltage is generally applied to an electroconductive roller, such as a charging roller, a developing roller, or a transferring roller, and hence a potential difference is generated between the DC voltage applied to the electroconductive roller and the surface potential of a photosensitive member. Meanwhile, a contaminant, such as toner or an external additive, having an insulating property is affected by sliding and the like in an electrophotographic image-forming apparatus, and thus part thereof has a positive or negative charge. Under the situation in which the potential difference is generated between the surface potentials of the electroconductive roller and the photosensitive member, any one of the positively charged contaminant and the negatively charged contaminant cannot be prevented from electrostatically adhering to the electroconductive roller in relation to the potential difference. For example, in the case of a charging roller which is arranged in abutment with the photosensitive member in an electrophotographic apparatus to charge the photosensitive member, the positively charged contaminant strongly electrostatically adheres to the charging roller side in relation to a potential difference between the charging roller and a photosensitive member drum.

In the method disclosed in Japanese Patent Application Laid-Open No. H06-266206, it is assumed that the contaminant adheres chemically or physically. Accordingly, the method has an adhesion-reducing effect on a contaminant having no charge.

As described above, however, the electrostatic adhesion of the contaminant is hard to be prevented. In the case of a cleaner-less system, most of transfer residual toner is positively charged, and hence the problem of the electrostatic adhesion to the charging roller becomes more remarkable.

The inventors of the present invention have analyzed contaminants adhering to the surface of the charging roller after image output in detail, and as a result, have confirmed that a large number of toner-derived organic components are detected. Further, the toner-derived contaminants have various forms such as deformed toner, finely powdered toner, and a mixture of finely powdered toner and an external additive. The toner-derived contaminants remaining on the photosensitive member are positively charged in many cases, and hence electrostatically adhere to the charging roller with ease. In particular, the deformed toner and the finely powdered toner are deteriorated in terms of developability, transferability, recoverability, and the like, and hence are liable to remain on the photosensitive member as positively chargeable contaminants.

In view of the foregoing, in order to reduce the amount of the contaminants adhering to the charging roller, it is effective to reduce toner-derived contaminants which are liable to be positively charged, particularly the deformed toner and the finely powdered toner. To this end, it has been found that the surface layer of the charging roller needs to satisfy the following conditions.

<Condition 1> The surface layer has a universal hardness at the surface thereof of 1.0 $N/mm^2$ or more and 7.0 $N/mm^2$ or less.

<Condition 2> The surface layer has, on the surface thereof, protruded portions derived from electroconductive fine particles.

<Condition 3> The surface layer has a volume resistivity of $1.0\times10^{10}$ Ωcm or more and $1.0\times10^{16}$ Ωcm or less.

The inventors of the present invention have confirmed that the fine powder amount of toner is increased when the hardness of the charging roller is high. This is probably because when passing between the charging roller and the photosensitive member, the toner is crushed therebetween, which causes cracking or deformation of the toner. This phenomenon becomes more remarkable in the case of the cleaner-less system. It has been found that when the condition 1 is satisfied, the charging roller becomes sufficiently flexible with respect to the toner to suppress the deformation or cracking of the toner due to the charging roller, with the result that the absolute amount of the contaminants remaining on the photosensitive member is reduced.

When the condition 1 is satisfied, the flexibility of the surface layer is high, and hence its tack is extremely strong, which increases the amount of the contaminants adhering to the charging roller. Therefore, as a measure for reducing the hardness of the surface layer of the charging roller, and at the same time, reducing the adhesion of the contaminants to the surface layer of the charging roller, the condition 2 is required. It has been found that when the protruded portions derived from the electroconductive fine particles are exposed on the surface layer as described in the condition 2, negative charges (electrons) can be injected from the protruded portions to the contaminants with high efficiency. It has been confirmed that as a result, the potentials of the contaminants adhering to the charging roller are changed from positively chargeable ones to negatively chargeable ones, and the contaminants return to the photosensitive member in relation to a potential difference between the charging roller and the photosensitive member. It has been found that when both the condition 1 and the condition 2 are satisfied, the adhesion amount of the contaminants accumulating on the charging roller can be reduced while the flexibility is maintained.

Further, it is necessary to satisfy the condition 3 in addition to the condition 1 and the condition 2. In the present invention, negative charges (electrons) are injected from the protruded portions derived from the electroconductive fine particles to the contaminants, to negatively charge the contaminants, by satisfying the condition 2. However, it has been confirmed that when the surface layer has low resistance, the contaminants hardly return to the photosensitive member, with the result that the adhesion amount of the contaminants depositing on the charging roller is increased. This is considered to suggest that when the negatively charged contaminants are brought into direct contact with the surface layer, particularly a binder resin having a surface at which the electroconductive fine particles are not exposed, the negative charges migrate to the surface layer side, and the negative charges of the contaminants decay. In order to suppress the decay of the negative charges, the surface layer needs to have high resistance, and to this end, the volume resistivity of the surface layer needs to be maintained within the range of from $1.0\times10^{10}$ Ωcm to $1.0\times10^{16}$ Ωcm.

As described above, it has been found that when the condition 1 to the condition 3 are all satisfied, the amount of the contaminants adhering to the charging roller can be significantly reduced.

<Construction of Electroconductive Member>

An electroconductive member for electrophotography according to the present invention includes, in this order, an electroconductive support, an electroconductive elastic layer, and a surface layer. When the electroconductive member has a roller shape, the electroconductive member for electrophotography has a construction including the electroconductive support, the elastic layer formed on the outer periphery of the electroconductive support, and the surface layer arranged on the outer periphery of the elastic layer.

It should be noted that the present invention is described in detail below by using an electroconductive member having a roller shape as an electroconductive member for electrophotography according to one embodiment of the present invention, but the electroconductive member for electrophotography according to the present invention is not limited to the roller shape.

<Electroconductive Support>

The electroconductive support to be used may be appropriately selected from those known in the field of electroconductive members for electrophotography. The electroconductive support is, for example, a cylinder having a carbon steel alloy surface coated with nickel plating having a thickness of about 5 μm.

<Electroconductive Elastic Layer>

The electroconductive elastic layer is obtained by, for example, dispersing an electroconductive agent in a polymer elastic body, followed by molding. Examples of the polymer elastic body include: a synthetic rubber such as an epichlorohydrin rubber, an acrylonitrile-butadiene rubber, a chloroprene rubber, a urethane rubber, or a silicone rubber; a synthetic rubber such as an ethylene-propylene rubber (EPM), an ethylene-propylene rubber (EPDM), a nitrile rubber (NBR), a butadiene rubber, or a styrene-butadiene rubber; a natural rubber, an isoprene rubber; and a thermoplastic elastomer, such as a styrene-butadiene-styrene block-copolymer (SBS) or a styrene-ethylenebutylene-styrene block-copolymer (SEBS).

The polymer elastic body is particularly suitably an epichlorohydrin rubber. When the epichlorohydrin rubber is used as the polymer elastic body, the elastic layer uniformly has electroconductivity in a medium-resistance region, and hence the electroconductive protruded portions on the surface layer serve as charge injection points, thereby allowing the injection of charges to the contaminants.

Examples of the epichlorohydrin rubber include an epichlorohydrin homopolymer, an epichlorohydrin-ethylene oxide copolymer, an epichlorohydrin-allyl glycidyl ether copolymer, and an epichlorohydrin-ethylene oxide-allyl glycidyl ether terpolymer. Of those, an epichlorohydrin-ethylene oxide-allyl glycidyl ether terpolymer is particularly suitably used because the terpolymer shows stable electroconductivity in the medium-resistance region. The electroconductivity and processability of the epichlorohydrin-ethylene oxide-allyl glycidyl ether terpolymer may be controlled by arbitrarily adjusting its degree of polymerization or composition ratio.

The polymer elastic body, which may be formed of the epichlorohydrin rubber alone, may contain any other general rubber than the epichlorohydrin rubber, such as the above-mentioned rubber, as required while containing the epichlorohydrin rubber as a main component. The general rubber is preferably used in an amount of from 1 part by mass to 50 parts by mass with respect to 100 parts by mass of the epichlorohydrin rubber.

An ion conductive agent or an electron conductive agent may be used as the electroconductive agent in the elastic layer. For the purpose of reducing unevenness of the electrical resistance of the elastic layer, the elastic layer preferably contains an ion conductive agent. When the ion conductive agent is uniformly dispersed in the elastic layer to uniformize the electrical resistance of the elastic layer, uniform charging can be obtained even when the charging roller is used under the application of a voltage formed only of a DC voltage.

The ion conductive agent is not particularly limited as long as the ion conductive agent exhibits ion conductivity, and examples thereof include: an inorganic ionic material, such as lithium perchlorate, sodium perchlorate, or calcium perchlorate; a quaternary ammonium salt, such as lauryl trimethylammonium chloride, stearyl trimethylammonium chloride, or tetrabutylammonium perchlorate; and an inorganic salt of an organic acid, such as lithium trifluoromethanesulfonate or potassium perfluorobutanesulfonate. One kind of those ion conductive agents may be used alone, or two or more kinds thereof may be used in combination. Of the ion conductive agents, a quaternary ammonium perchlorate is particularly suitably used because of stable electrical resistance of the elastic layer against an environmental change.

The electron conductive agent is not particularly limited as long as the electroconductive particles exhibit electron conductivity, and examples thereof include: carbon black, such as furnace black, thermal black, acetylene black, or Ketjen black; metal oxide-based electroconductive particles, such as titanium oxide, tin oxide, or zinc oxide; and metal-based electroconductive particles, such as aluminum, iron, copper, or silver. In addition, one kind of those electroconductive agents may be used alone, or two or more kinds thereof may be used in combination.

The compounding amount of the electroconductive agent is preferably determined so that the volume resistivity of the elastic layer falls within the range of from $1\times10^3$ Ω·cm to $1\times10^9$ Ω·cm under each of a low-temperature and low-humidity environment (temperature: 15° C., relative humidity: 10%), a normal-temperature and normal-humidity environment (temperature: 23° C., relative humidity: 50%), and a high-temperature and high-humidity environment (temperature: 30° C., relative humidity: 80%). This is because a charging member exhibiting satisfactory charging performance is obtained. In addition to the foregoing, as required, the elastic layer may contain the following compounding agents: a plasticizer, a filler, a vulcanizing agent, a vulcanization accelerator, an age resistor, an anti-scorching agent, a dispersant, and a release agent. The volume resistivity of the elastic layer may be measured using a sample for volume resistivity measurement obtained by: molding a composition formed of all materials to be used in the elastic layer into a sheet having a thickness of 1 mm; and depositing metals from the vapor onto both surfaces of the sheet to form an electrode and a guard electrode. A specific measurement method therefor is similar to a measurement method for the volume resistivity of the surface layer to be described later.

The hardness of the elastic layer is preferably 50° or more and 70° or less, more preferably 50° or more and 60° or less in terms of microhardness (Model MD-1). When the microhardness (Model MD-1) is set to 50° or more, the occurrence of an uneven density of an image derived from the deformation of the charging roller which occurs in the case where the charging roller and the electrophotographic photosensitive member are held in abutment with each other for a long period of time in a state of rest can be suppressed. When the microhardness (Model MD-1) is set to 70° or less, preferably 60° or less, a sufficient nip width can be secured between the charging member and the photosensitive member, and the number of occasions of contact between the protruded portions derived from the electroconductive fine particles exposed at the surface of the surface layer of the present invention and the contaminants, such as toner and an external additive, can be increased.

It should be noted that the "microhardness (Model MD-1)" is a hardness measured using a micro-rubber hardness tester (trade name: MD-1 capa Type C, manufactured by Kobunshi Keiki Co., Ltd.).

As a pressing needle, one having a hemispherical shape having a height of 0.50 mm and a diameter of 1.00 mm is used.

Specifically, first, the surface layer is removed by being peeled off or cut off, and the member for electrophotography having the surface of the elastic layer thus exposed is left to stand still under a normal-temperature and normal-humidity (temperature: 23° C., relative humidity: 55%) environment for 12 hours. The resultant is used as a sample for measurement. Then, through the use of the hardness tester, the pressing needle is pressed against the surface of the sample for measurement at a force of 10 N, and a value 30 seconds after abutment is read. It should be noted that the measurement mode is set to a peak-hold mode.

As a method of forming the elastic layer, it is preferred to mix raw materials including the electroconductive agent and the polymer elastic body with a closed mixer, followed by forming by a known method such as extrusion molding, injection molding, or compression molding. In addition, the elastic layer may be produced by directly molding the electroconductive elastic body on the electroconductive support, or may be formed by covering the electroconductive support with the electroconductive elastic body which has been molded into a tube shape in advance. It should be noted that after the production of the elastic layer, its surface may be ground to adjust its shape.

<Surface Layer>

The surface layer of the electroconductive member for electrophotography according to the present invention is a layer containing a binder resin and electroconductive fine particles which are dispersed in the binder resin and have a number average particle diameter of 5.0 nm or more and 50.0 nm or less. The surface layer may contain roughening particles, a surface release agent, or the like as required in addition to the binder resin and the electroconductive fine particles.

<Binder Resin>

A known binder resin may be used as the binder resin. Examples thereof may include a resin, and a rubber, such as a natural rubber or a vulcanized product thereof, or a synthetic rubber. As the resin, there may be used, for example, a fluororesin, a polyamide resin, an acrylic resin, a polyurethane resin, a silicone resin, a butyral resin, a styrene-ethylene/butylene-olefin copolymer, and an olefin-ethylene/butylene-olefin copolymer. It should be noted that the binder resin of the present invention is preferably free of any ether bond of polyethylene oxide, polypropylene oxide, or the like. This is because an ether-based urethane resin can reduce the universal hardness but decreases the volume resistivity of the resin, and hence is not suitable as the binder resin of the present invention. One kind of the binder resins may be used alone, or two or more kinds thereof may be used in combination. Of those, in order to achieve both flexibility based on a reduction in universal hardness of the surface layer and increased resistance of the surface layer, the binder resin is particularly preferably a resin containing a polycarbonate structure. The polarity of the polycarbonate structure is low, and hence the volume resistivity of the binder resin itself can be maintained at a high value. Specifically, polycarbonate-based polyurethane obtained by copolymerizing a polycarbonate polyol and a polyisocyanate is preferred.

Examples of the polycarbonate polyol include a polynonamethylene carbonate diol, a poly(2-methyl-octamethylene) carbonate diol, a polyhexamethylenecarbonate diol, a polypentamethylenecarbonate diol, a poly(3-methylpentamethylene)carbonate diol, a polytetramethylenecarbonate diol, a polytrimethylenecarbonate diol, a poly(1,4-cyclohexane dimethylenecarbonate) diol, a poly(2-ethyl-2-butyl-trimethylene)carbonate diol, and random/block copolymers thereof.

The polyisocyanate is selected from known polyisocyanates, which are generally used, and examples thereof include toluene diisocyanate (TDI), diphenylmethane diisocyanate (MDI), polymeric diphenylmethane polyisocyanate, hydrogenated MDI, xylylene diisocyanate (XDI), hexamethylene diisocyanate (HDI), and isophorone diisocyanate (IPDI). Of those, an aromatic isocyanate, such as toluene diisocyanate (TDI), diphenylmethane diisocyanate (MDI), or polymeric diphenylmethane polyisocyanate, is more suitably used.

<Electroconductive Fine Particles>

The surface layer contains electroconductive fine particles having a number average particle diameter of 5.0 nm or more and 50.0 nm or less. Examples of the electroconductive fine particles may include: carbon black; metal oxide-based electroconductive particles, such as titanium oxide, tin oxide, and zinc oxide; and metal-based electroconductive particles, such as aluminum, iron, copper, and silver. One kind of those electroconductive particles may be used alone, or two or more kinds thereof may be used in combination. In addition, as the electroconductive particles, there may also be used composite particles obtained by covering silica particles with electroconductive particles. Carbon black is preferred as the electroconductive fine particles to be used for the surface layer. Carbon black has a low specific gravity and high electroconductivity, and hence allows sufficient electroconductivity of the surface layer to be secured by being added in a small amount with respect to the binder resin. In the present invention, the hardness of the surface layer needs to be kept low, and hence carbon black is suitable.

<Protruded Portions Derived From Electroconductive Fine Particles>

In the present invention, it is necessary to maintain the flexibility of the surface layer and to significantly reduce the adhesion amount of the contaminants. Specifically, the protruded portions derived from the exposed portions of the electroconductive fine particles are utilized to inject charges to the contaminants, and hence it is important to control the size of the protruded portions. A schematic view of the state of the exposed portions of the electroconductive fine particles of the present invention is illustrated in FIG. 1. A binder resin of the present invention is denoted by reference numeral 11, electroconductive fine particles are denoted by reference numeral 12, and exposed electroconductive fine particles are denoted by reference numeral 13. The size of the protruded portions derived from the exposed portions of the electroconductive fine particles is preferably 5.0 nm or more and 100.0 nm or less. When the size is set to 5.0 nm or more, the protruded portions can function as origins for injecting charges to the contaminants. In addition, when the size is set to 100.0 nm or less, the injection of an excess charge to the photosensitive member can be suppressed. It should be noted that the size of the protruded portions means the number average particle diameter of the electroconductive fine particles at portions exposed from the binder resin as denoted by reference numeral 14 in FIG. 1. As a measurement method for the size of the protruded portions, an image of an arbitrary 2-μm square region is taken using a scanning electron microscope (SEM), and particle diameters are measured for 20 particles randomly selected from the resultant image, followed by the determination of their arithmetic average unidirectional particle diameter.

In addition, in the present invention, the protruded portions derived from the electroconductive fine particles are utilized to inject charges to the contaminants, and hence it is important to control the number of the protruded portions. The number of the protruded portions derived from the exposed portions of the electroconductive fine particles is preferably 50 or more and 500 or less in a region measuring 2.0 μm long by 2.0 μm wide (4.0-$\mu m^2$ region). When the number is set to 50 or more, a sufficient number of the protruded portions serving as origins for injecting charges to the contaminants can be secured. In addition, when the number is set to 500 or less, the injection of a charge to the photosensitive member can be suppressed. The number of the protruded portions may be calculated as follows: an image of an arbitrary 2-μm square region is taken using a scanning electron microscope (SEM), and the number of electroconductive points is calculated based on the image after binarization.

Next, a technique for exposing the electroconductive fine particles at the surface of the surface layer of the present invention is described.

Figure 2:
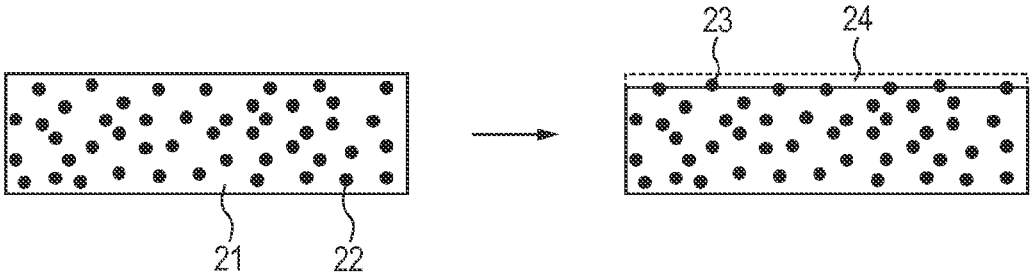
FIG. 2 is an explanatory view of the construction of the surface layer of the electroconductive member according to the present invention.

When the surface layer is formed on the electroconductive elastic layer of the electroconductive member by a dipping application method, a skin layer is inevitably formed at the outermost surface of the surface layer. Consequently, the electroconductive fine particles are not exposed at the surface of the surface layer, and the effect of injecting electrons to the contaminants is not sufficiently obtained. In order to expose at least part of the electroconductive fine particles at the surface of the surface layer and to form the protruded portions derived from the exposed portions thereof on the surface of the surface layer, it is necessary to remove the skin layer at the outermost surface. For example, as illustrated in FIG. 2, a surface skin layer 24 of a binder resin 21 may be removed to expose electroconductive fine particles 22 at the surface of the surface layer, by performing UV treatment, a grinding method, an electrolytic grinding method, a chemical grinding method, an ion milling method, or the like. Electroconductive fine particles exposed at the surface are denoted by reference numeral 23 in FIG. 2. In the present invention, by virtue of the low hardness of the surface layer, the skin layer can be sufficiently removed to expose the electroconductive fine particles at the surface of the surface layer even by the UV treatment. As compared to the grinding method or the like, the UV treatment can expose the electroconductive fine particles at the surface of the surface layer while minimizing damage to the surface layer, and hence is preferred.

An exposure state of the electroconductive fine particles may be confirmed using an atomic force microscope (AFM). A topographic image is acquired with the AFM in a tapping mode. In this case, portions derived from the exposed portions of the electroconductive fine particles are observed as the protruded portions. In the case where the topographic image is acquired under a state after dip coating in which the skin layer is present, the protruded portions are not observed. Further, a phase image is acquired with the AFM in the tapping mode. In this case, the phase shift of the electroconductive fine particles is small, and by virtue of a hardness difference between the binder resin and the electroconductive fine particles, an image having an extremely large tone contrast difference is obtained. In the case where the phase image is acquired under a state after dip coating in which the skin layer is present, a phase difference is extremely small, and an image having a low contrast difference is acquired.

<Roughening Particles>

The surface layer may contain roughening particles to the extent that the effect of the present invention is not impaired. Examples of the roughening particles include: organic insulating particles, such as particles of an acrylic resin, a polycarbonate resin, a styrene resin, a urethane resin, a fluororesin, and a silicone resin; and inorganic insulating particles, such as particles of titanium oxide, silica, alumina, magnesium oxide, strontium titanate, barium titanate, barium sulfate, calcium carbonate, mica, zeolite, and bentonite. In the present invention, the number of occasions of contact with the contaminants, such as an external additive and toner, needs to be increased through the deformation of the surface layer, and hence organic insulating particles having flexibility are preferably used as the roughening particles. One kind of those particles may be used, or two or more kinds thereof may be used in combination. The number average particle diameter of the roughening particles is not particularly limited, but is about 3 μm or more and about 30 μm or less.

<Other Additive>

In the present invention, any other additive may be added into the surface layer as required to the extent that the effect of the present invention is not impaired. As the additive, for example, chain extenders, crosslinking agents, pigments, silicone additives, and amines and tin complexes serving as catalysts may be added. The addition of the silicone additive to the surface layer increases the resistance of the surface layer and imparts slidability to the surface layer, thereby suppressing the injection of a charge to the photosensitive member and improving the wear resistance of the surface layer. Thus, the addition of the silicone additive is particularly preferred.

<Layer Thickness of Surface Layer>

The surface layer has a thickness of preferably 0.1 μm or more and 100 μm or less, more preferably 1 μm or more and 50 μm or less. It should be noted that the film thickness of the surface layer may be measured by cutting a cross-section out of the roller with a sharp blade and observing the cross-section with an optical microscope or an electron microscope.

<Universal Hardness of Surface Layer>

In the present invention, it is extremely important to prevent a contaminant of interest, particularly toner, from being cracked or deformed, and hence the surface layer is required to have an unprecedented level of flexibility. A target hardness of the electroconductive member of the present invention is a "universal hardness (t=1 μm position)" at a depth of 1 μm from the surface of the surface layer of 1.0 $N/mm^2$ or more and 7.0 $N/mm^2$ or less. An external additive or toner serving as the contaminant of interest has a size of a submicron to several-micron order, and hence it is necessary to control the hardness of the very outermost surface of the surface layer. When the universal hardness of the surface of the surface layer when an indenter is driven 1 μm from the surface thereof is set to 1.0 $N/mm^2$ or more, the occurrence of an uneven density of an image derived from deformation of the charging roller which occurs in the case where the charging roller and the electrophotographic photosensitive member are held in abutment with each other for a long period of time in a state of rest can be suppressed. In addition, when the universal hardness is set to 7.0 $N/mm^2$ or less, deformation and cracking of toner can be suppressed, and hence the absolute amount of deformed toner and finely powdered toner remaining on the photosensitive member can be reduced. Further, when the universal hardness is set to 5.0 $N/mm^2$ or less, the surface layer deforms by following the contaminants, and hence the number of points at which the protruded portions derived from the electroconductive fine particles exposed at the surface of the surface layer are brought into contact with the contaminants is increased to improve the injection efficiency of electrons from the protruded portions to the contaminants.

A surface layer having a universal hardness within the above-mentioned numerical range may be obtained by a method as described below. A network structure made of the binder resin needs to be preciously controlled by the selection of the binder resin as described above. The urethane resin obtained by copolymerizing the polyol and the polyisocyanate is particularly preferred as the binder resin. Specifically, the urethane resin can be obtained by a thermal-curing reaction of the isocyanate-terminated prepolymer which is obtained by copolymerizing the raw material polyol having a molecular weight of 1,000 to 3,000 and the isocyanate. Polymeric MDI is preferable as the isocyanate. When raw material polyol has a molecular weight of 1,000 or more, enough flexibility of the surface layer is obtained. When polymeric MDI is used as the isocyanate, excessive use of the isocyanate is avoided and thus urethane in which the amount of an unreacted polyol or polar functional groups is small can be obtained. As a result, the volume resistivity of the binder resin can be increased and the universal hardness of the surface layer can be reduced.

It should be noted that the universal hardness of the surface of the surface layer of the charging roller is measured using, for example, a universal hardness tester (trade name: FISCHERSCOPE HM-2000XYp, manufactured by Fischer Instruments K.K.). The universal hardness is a physical property value determined by driving an indenter into a measurement object under the application of a load thereto, and is determined as "(test load)/(surface area of indenter under test load) ($N/mm^2$)." An indenter having the shape of a square pyramid or the like is driven into an object to be measured under the application of a predetermined relatively small test load, and when the indenter reaches a predetermined indentation depth, the surface area of the indenter brought into contact with the surface layer is determined based on the indentation depth, followed by the determination of the universal hardness from the above-mentioned expression.

[Martens Hardness]

In addition, in the present invention, roughening particles may be added into the surface layer to form a protruded portion derived from the roughening particles on the surface of the surface layer. In this case, the roughening particles to be used have, for example, a number average particle diameter of 3 μm or more and 30 μm or less.

In addition, in a surface layer containing such roughening particles and having the protruded portion derived from the particles formed on the surface thereof, a surface hardness at the protruded portion derived from the particles is preferably set to a predetermined value or less. In this case, in the present invention, the surface hardness of the surface layer at the protruded portion derived from the roughening particles for roughness adjustment is expressed in "Martens hardness" as described below. In addition, the Martens hardness at the protruded portion derived from the roughening particles is preferably 10.0 $N/mm^2$ or less, particularly preferably 5.0 $N/mm^2$ or less. With this, the generation of a flaw in the surface of the photosensitive member when the charging roller is brought into contact with the photosensitive member can be suppressed. In addition, the deformation of toner due to the protruded portion derived from the particles can be suppressed.

The Martens hardness of the surface layer of the charging roller at the protruded portion derived from the particles may be measured using, for example, an ultra-micro hardness tester (trade name: PICODENTOR HM-500, manufactured by Fischer Instruments K.K.). As an indenter for the measurement, a Vickers indenter made of diamond having a square pyramid shape is used. In addition, measurement conditions are as follows: the tip of the Vickers indenter is brought into abutment with the center of the protruded portion derived from the particles of the surface layer of the charging roller, the indenter is then driven into the surface layer at a predetermined speed, and a Martens hardness (N=0.04 mN) when the load reaches 0.04 mN is measured. In addition, the Martens hardness at the protruded portion derived from the roughening particles thus measured correlates well with a suppressing effect on cracking or deformation of toner which causes contamination of the surface of the charging roller.

<Volume Resistivity of Surface Layer>

In the present invention, the volume resistivity of the surface layer is $1.0\times10^{10}$ Ωcm or more and $1.0\times10^{16}$ Ωcm or less. The volume resistivity of the surface layer of the charging roller needs to be set to a large value. It has been confirmed that when the volume resistivity of the surface layer is small, the contaminants hardly return to the photosensitive member, with the result that the adhesion amount of the contaminants depositing on the charging roller is increased. The inventors of the present invention consider that this suggests that when the negatively charged contaminants are brought into direct contact with the surface layer, particularly the binder resin having a surface at which the electroconductive fine particles are not exposed, the negative charges of the contaminants migrate to the surface layer side of the charging roller, and the negative charges of the contaminants decay. In order to suppress the decay of the negative charges of the contaminants, the surface layer needs to have high resistance, and to this end, the volume resistivity of the surface layer needs to be set to $1.0\times10^{10}$ Ωcm or more.

In addition, it has been confirmed that when the volume resistivity of the surface layer is low, a charge is injected from the charging roller to the photosensitive member. This phenomenon becomes remarkable in the case where the hardness of the surface layer is low, and further, in the case where a circumferential speed difference is provided between the charging roller and the photosensitive member. During actual image output, an injection charge amount is added to a charge amount due to a discharge, and hence when the injection charge amount is large, it is difficult to keep the surface potential of the photosensitive member stable. A target injection charge amount for maintaining output at a stable image density is 50 V or less, and to this end, the volume resistivity of the surface layer is preferably set to $1.0\times10^{12}$ Ωcm or more.

In addition, when the volume resistivity of the surface layer is high, the discharge becomes unstable in the charging roller, and hence the volume resistivity of the surface layer needs to be $1.0\times10^{16}$ Ωcm or less.

The injection charge amount from the charging roller to the photosensitive member is measured, for example, as follows: the injection charge amount may be estimated by measuring the surface potential of the photosensitive member when a voltage is applied to the charging roller under conditions which do not cause the charging roller to discharge (e.g., DC-500 V) under a high-temperature and high-humidity environment (temperature: 30° C., relative humidity: 80%) where the injection charge amount is increased.

With regard to the measurement of the volume resistivity of the surface layer, a measurement value measured using an atomic force microscope (AFM) in an electroconductive mode may be adopted. A sheet is cut out of the surface layer of the charging roller using a manipulator, and a metal is deposited from the vapor onto one surface of the surface layer. The surface onto which the metal has been deposited from the vapor is connected to a DC power source, and a voltage is applied. The free end of a cantilever is brought into contact with the other surface of the surface layer, and a current image is obtained through the main body of the AFM. Current values at randomly selected 100 sites in the surface are measured, and the volume resistivity may be calculated based on the average current value of the ten lowest current values measured, an average film thickness, and the contact area of the cantilever.

<Process Cartridge and Electrophotographic Image-Forming Apparatus>

The electroconductive member according to the present invention may be incorporated as a charging member into each of a process cartridge and an electrophotographic image-forming apparatus. A process cartridge according to the present invention includes an electrophotographic photosensitive member, and a charging member arranged in contact with the electrophotographic photosensitive member, the process cartridge being removably mounted onto the main body of an electrophotographic image-forming apparatus, in which the charging member is the above-mentioned electroconductive member for electrophotography. An electrophotographic image-forming apparatus according to the present invention includes an electrophotographic photosensitive member, and a charging member arranged in contact with the electrophotographic photosensitive member, in which the charging member is the above-mentioned electroconductive member for electrophotography.

Figure 3:
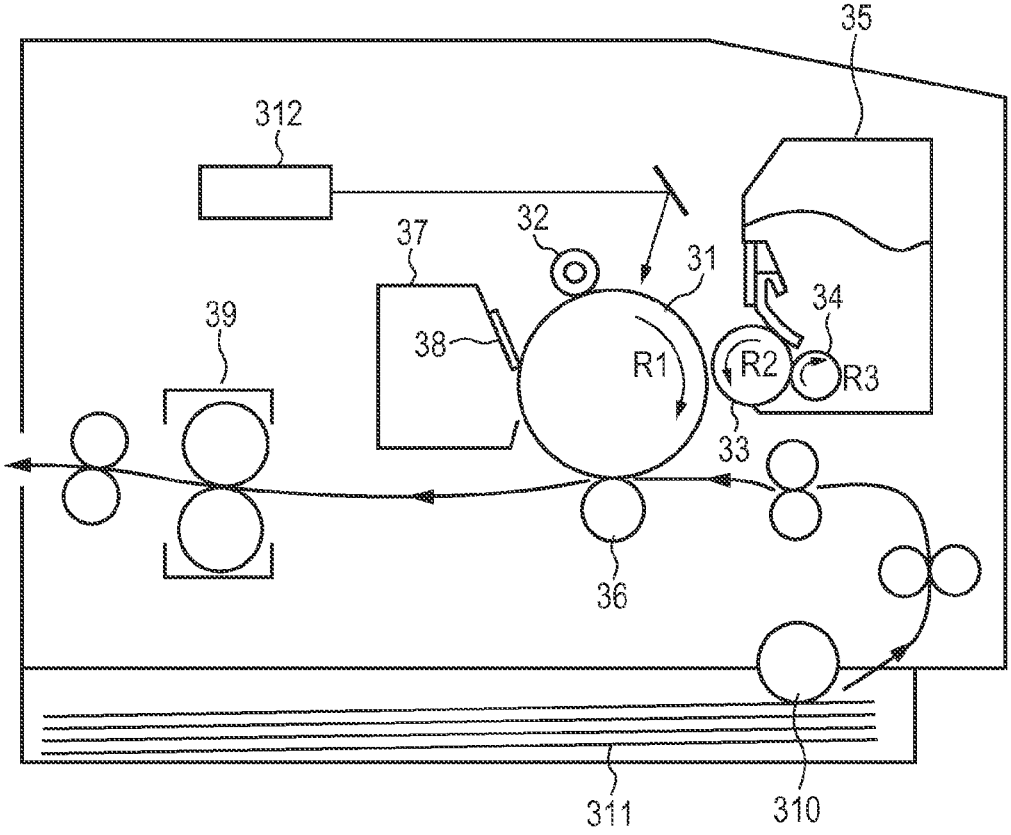
FIG. 3 is an explanatory view of an electrophotographic apparatus according to the present invention.

FIG. 3 is a schematic cross-sectional view for illustrating an example of the electrophotographic image-forming apparatus of the present invention. An electrostatic latent image-bearing member (electrophotographic photosensitive member) 31, which is an image-bearing member having an electrostatic latent image formed thereon, is rotated in a direction indicated by the arrow R1. A toner-carrying member 33 is rotated in a direction indicated by the arrow R2, thereby conveying toner to a developing region where the toner-carrying member 33 and the electrostatic latent image-bearing member are opposed to each other. In addition, a toner-supplying member 34 is brought into contact with the toner-carrying member, and is rotated in a direction indicated by the arrow R3, thereby supplying the toner to the surface of the toner-carrying member.

Around the electrostatic latent image-bearing member 31, there are arranged a charging member (charging roller) 32, a transferring member (transfer roller) 36, a cleaner container 37, a cleaning blade 38, a fixing device 39, a pickup roller 310, and the like. The electrostatic latent image-bearing member 31 is charged by the charging roller 32. Then, the electrostatic latent image-bearing member 31 is exposed by being irradiated with laser light through the use of a laser-generating apparatus 312, and thus an electrostatic latent image corresponding to an image of interest is formed on the charged surface of the electrostatic latent image-bearing member. The electrostatic latent image on the electrostatic latent image-bearing member is developed with the toner in a developing device 35 to provide a toner image. The toner image is transferred onto a transfer material (paper) 311 by the transferring member (transfer roller) abutting with the electrostatic latent image-bearing member through the intermediation of the transfer material. The transfer material (paper) having the toner image thereon is carried to the fixing device, and the toner image is fixed onto the transfer material (paper). In addition, part of the toner remaining on the electrostatic latent image-bearing member is scraped off with the cleaning blade and stored in the cleaner container.

As a charging apparatus included in the electrophotographic image-forming apparatus of the present invention, it is preferred to use a contact charging apparatus in which an electrostatic latent image-bearing member and a charging roller are brought into contact with each other while forming an abutment portion and which is configured to charge the surface of the electrostatic latent image-bearing member to a predetermined polarity and potential by applying a predetermined charging bias to the charging roller. When contact charging is performed as just described, stable uniform charging can be performed, and moreover, the generation of ozone can be reduced. In addition, in order to perform uniform charging by keeping the contact with the electrostatic latent image-bearing member uniform, it is more preferred to use a charging roller configured to be rotated in the same direction as the electrostatic latent image-bearing member.

A contact transferring step to be preferably applied in the electrophotographic image-forming apparatus of the present invention is exemplified by a step of electrostatically transferring the toner image onto a recording medium while the electrostatic latent image-bearing member is held in abutment with the transferring member having a voltage opposite in polarity to the toner applied thereto through the intermediation of the recording medium.

In the electrophotographic image-forming apparatus of the present invention, it is preferred that the thickness of a toner layer on the developer-carrying member be regulated by bringing a toner layer thickness-regulating member into abutment with the developer-carrying member through the intermediation of the toner. The toner layer thickness-regulating member to be brought into abutment with the developer-carrying member is generally a regulating blade, which may be suitably used in the present invention as well.

As the regulating blade, there may be used: a rubber elastic body, such as a silicone rubber, a urethane rubber, or NBR; a synthetic resin elastic body, such as polyethylene terephthalate; a metal elastic body, such as a phosphor-bronze plate or an SUS plate; or a composite thereof. Further, for the purpose of controlling toner chargeability, an elastic support, such as a rubber, a synthetic resin, or a metal elastic body, having a charge control substance, such as a resin, a rubber, a metal oxide, or a metal, bonded thereto so as to be brought into contact with the abutment portion of the developer-carrying member may be used. Of those, a metal elastic body having a resin or a rubber bonded thereto so as to be brought into contact with the abutment portion of the developer-carrying member is particularly preferred. A material for the member to be bonded to the metal elastic body is preferably one which is easy to charge to a positive polarity, such as a urethane rubber, a urethane resin, a polyamide resin, or a nylon resin.

A base portion serving as the upper edge side of the regulating blade is fixed and held onto the developing device side, and its lower edge side is brought into abutment with the surface of the developer-carrying member with an appropriate elastic pressing force in a state of being bent against the elastic force of the blade in the forward direction or reverse direction of the developer-carrying member.

It is effective that an abutting pressure between the regulating blade and the developer-carrying member is preferably 1.27 N/m or more and 245.00 N/m or less, more preferably 4.9 N/m or more and 118.0 N/m or less in terms of linear pressure in the generatrix line direction of the developer-carrying member. When the abutting pressure is 1.27 N/m or more, it is possible to uniformly apply toner, with the result that fog or scattering can be effectively prevented. When the abutting pressure is 245 N/m or less, the deterioration of the toner can effectively be prevented.

The amount of the toner layer on the developer-carrying member is preferably 2.0 $g/m^2$ or more and 12.0 $g/m^2$ or less, more preferably 3.0 $g/m^2$ or more and 10.0 $g/m^2$ or less. When the amount of the toner on the developer-carrying member is 2.0 $g/m^2$ or more, a sufficient image density can be obtained. On the other hand, when the amount of the toner on the developer-carrying member is 12.0 $g/m^2$ or less, regulation failure can be prevented effectively It should be noted that in the present invention, the amount of the toner on the developer-carrying member may be arbitrarily changed by changing the surface roughness (Ra) of the developer-carrying member, the free length of the regulating blade, and the abutting pressure of the regulating blade.

In order to develop the toner carried on the developer-carrying member, a developing bias voltage serving as a bias unit is applied to the developer-carrying member. When a DC voltage is used as the developing bias voltage, a voltage having a value between the potential of an image portion of the electrostatic latent image (region to be visualized through the adhesion of a developer) and the potential of a non-image portion of the electrostatic latent image (region to which the developer does not adhere) is preferably applied to the developer-carrying member. The absolute value (Vcontrast) of a difference between the potential of the image portion of the electrostatic latent image and the developing bias potential preferably falls within the range of from 50 V or more to 400 V or less. When the absolute value is set to fall within this range, an image having a suitable density is formed. In addition, in order to increase the density of the developed image and improve tone reproduction, an alternating bias voltage may be applied to the developer-carrying member to form an oscillating electric field whose direction alternately inverts in the developing region.

The absolute value (Vback) of a difference between the potential of the non-image portion of the electrostatic latent image and the developing bias potential preferably falls within the range of from 50 V or more to 600 V or less. When the absolute value is set to fall within this range, development of the toner in the non-image portion can be suitably suppressed.

Particularly in the case of a cleaner-less system having the cleaner container 11 and the cleaning blade 12 removed, Vback becomes insufficient due to paper dust adhering onto the photosensitive member, with the result that image failure is liable to occur, and toner remaining on the photosensitive member instead of being transferred onto paper needs to be recovered again in a developing container for storing toner, and hence Vback is preferably set to have a high value. The value is preferably set to fall within the range of from 300 V or more to 600 V or less.

In the electrophotographic image-forming apparatus of the present invention, the charging member is preferably configured to move at a different speed from that of the electrophotographic photosensitive member (electrostatic latent image-bearing member). In addition, the charging member is preferably configured to move while keeping the speed difference in a forward direction with respect to the moving direction of the electrophotographic photosensitive member. When such configuration is adopted in a cleaner-less electrophotographic image-forming apparatus, the migration of transfer residual toner on the electrophotographic photosensitive member onto the surface of the charging member can be suppressed.

According to the present invention, the adhesion amount of a toner-derived contaminant serving as a cause of electrostatic adhesion is reduced. Further, through the injection of a charge from the electroconductive roller to the contaminant, and through the utilization of a potential difference between the electroconductive member and the photosensitive member, the contaminant can be returned to the photosensitive member. As a result, the amount of contamination adhering to the charging roller can be dramatically reduced independent of use conditions and a use environment, and thus the electroconductive member capable of stably charging the photosensitive member over a long period of time can be obtained. According to the present invention, the process cartridge and the electrophotographic image-forming apparatus which are capable of forming high-quality electrophotographic images can also be provided.

Now, the present invention is described in more detail by way of Examples.

Example 1

1. Preparation of Unvulcanized Rubber Composition

Materials whose kinds and amounts were as shown in Table 1 below were mixed with a pressure kneader to provide an A kneaded rubber composition. Further, 183.0 parts by mass of the A kneaded rubber composition and materials whose kinds and amounts were as shown in Table 2 below were mixed with an open roll to prepare an unvulcanized rubber composition.

TABLE 1

| Material | Part(s) by mass |
|---|---|
| Epichlorohydrin-ethylene oxide-allyl glycidyl ether terpolymer (GECO) (trade name: EPICHLOMER CG-102, manufactured by Daiso Co., Ltd.) | 100.0 |
| Zinc oxide (zinc oxide Type II, manufactured by Seido Chemical Industry Co., Ltd.) | 5.0 |
| Calcium carbonate (trade name: Silver-W, manufactured by Shiraishi Calcium Kaisha, Ltd.) | 60.0 |
| Carbon black (trade name: Thermax Floform N990, manufactured by Cancarb) | 5.0 |
| Stearic acid | 1.0 |
| Aliphatic polyester-based plasticizer (trade name: POLYCIZER P202, manufactured by Dainippon Ink and Chemicals, Incorporated) | 10.0 |
| Quaternary ammonium salt (trade name: ADK CIZER LV-70, manufactured by ADEKA Corporation) | 2.0 |

TABLE 2

| | Material | Part by mass |
|---|---|---|
| Crosslinking agent | Sulfur (trade name: Sulfax PMC, manufactured by Tsurumi Chemical Industry Co., Ltd.) | 0.8 |
| Vulcanization accelerator | Dibenzothiazolyl disulfide (trade name: NOCCELER DM, manufactured by Ouchi Shinko Chemical Industrial Co., Ltd.) | 1.0 |
| Vulcanization accelerator | Tetrabenzylthiuram monosulfide (trade name: NOCCELER TS, manufactured by Ouchi Shinko Chemical Industrial Co., Ltd.) | 0.5 |

2. Production of Electroconductive Elastic Roller

There was prepared a round bar having an overall length of 252 mm and an outer diameter of 6 mm obtained by subjecting the surface of free-cutting steel to electroless nickel plating. Next, an adhesive was applied to a 230-mm region of the round bar excluding both end portions each having a length of 11 mm over the entire circumference. The adhesive used was of an electroconductive hot-melt type. In addition, a roll coater was used for the application. In this example, the round bar having the adhesive applied thereto was used as an electroconductive support.

Next, a crosshead extruder having a mechanism for supplying an electroconductive support and a mechanism for discharging an unvulcanized rubber composition was prepared, a die having an inner diameter of 12.5 mm was attached to a crosshead, and the temperature of each of the extruder and the crosshead, and the conveyance speed of the electroconductive support were adjusted to 80° C. and 60 mm/sec, respectively. Under these conditions, the unvulcanized rubber composition was supplied from the extruder, and in the crosshead, the electroconductive support was covered with the unvulcanized rubber composition serving as an elastic layer. Thus, an unvulcanized rubber roller was obtained. Next, the unvulcanized rubber roller was loaded into a hot-air vulcanization furnace at 170° C., and heated for 60 minutes to provide an unground electroconductive elastic roller. After that, end portions of the elastic layer were cut off and removed. Finally, the surface of the elastic layer was ground with a rotary grindstone. Thus, an electroconductive elastic roller having a central portion diameter of 8.5 mm was obtained. It should be noted that the roller had a crown amount (average value of a difference between the outer diameter at a central portion and the outer diameter at a position away from the central portion by 90 mm toward each of both end portion directions) of 110 μm.

3. Production of Coating Liquid 1

A coating liquid of a binder resin for forming the surface layer according to the present invention was produced by the following technique. Under a nitrogen atmosphere, 100 parts by mass of a polyester polyol (trade name: P3010, manufactured by Kuraray Co., Ltd.) was gradually added dropwise to 27 parts by mass of polymeric MDI (trade name: MILLIONATE MR200, manufactured by Nippon Polyurethane Industry Co., Ltd.) in a reaction vessel while the temperature in the reaction vessel was kept at 65° C. After the completion of the dropwise addition, the mixture was subjected to a reaction at a temperature of 65° C. for 2 hours. The resultant reaction mixture was cooled to room temperature to provide an isocyanate group-terminated prepolymer 1 having an isocyanate group content of 4.3%.

With respect to 54.9 parts by mass of the isocyanate group-terminated prepolymer 1, 41.52 parts by mass of another polyester polyol (trade name: P2010, manufactured by Kuraray Co., Ltd.) and 30 parts by mass of carbon black (MA230: manufactured by Mitsubishi Chemical Corporation, number average particle diameter: 30 nm) were dissolved in methyl ethyl ketone (MEK) so as to adjust the solid content to 27 mass %. Thus, a mixed liquid 1 was produced. 270 g of the mixed liquid 1 and 200 g of glass beads having an average particle diameter of 0.8 mm were loaded into a glass bottle having an internal volume of 450 mL, and were dispersed for 12 hours using a paint shaker dispersing machine. After the dispersion, 30 parts by mass of urethane particles having an average particle diameter of 7.0 μm (DAIMICBEAZ UCN-5070D: manufactured by Dainichiseika Color & Chemicals Mfg. Co., Ltd.) was added. After that, the mixture was further dispersed for 15 minutes, and the glass beads were removed to provide a coating liquid 1 for a surface layer.

4. Coating of Electroconductive Roller

The electroconductive elastic roller produced in the section 2 was dipped in the coating liquid 1 for a surface layer produced by the technique of the section 3 with its longitudinal direction being a vertical direction and its upper end portion being held, and was lifted, followed by air drying at 23° C. for 30 minutes. Then, the resultant was dried in a circulating hot air dryer set to 80° C. for 1 hour, and further dried in a circulating hot air dryer set to 160° C. for 1 hour. Thus, a surface layer was formed on the outer peripheral surface of the electroconductive elastic roller. In the dipping application, a dipping time was 9 seconds, and a roller-lifting speed was adjusted to 20 mm/sec as an initial speed and 2 mm/sec as a final speed, and the speed was linearly changed with time between 20 mm/sec and 2 mm/sec.

5. Production of Protruded Portions Derived from Electroconductive Fine Particles The electroconductive roller produced by the technique of the section 4 was irradiated with UV light having a wavelength of 254 nm so as to achieve an integrated light quantity of 9,000 mJ/cm$^2$, to thereby decompose the binder resin at the outermost surface of the surface layer. The irradiation with UV light was performed using a low-pressure mercury lamp (manufactured by Harison Toshiba Lighting Corporation). An electroconductive roller 1 was produced by the technique described above.

6. Characteristic Evaluation

Next, the obtained electroconductive roller 1 was subjected to the following evaluation tests. The evaluation results are shown in Table 9.

<Evaluation 6-1. Measurement of Film Thickness of Surface Layer>

The film thickness of the surface layer was measured by observing cross-sections at a total of nine sites, i.e., three sites in the axial direction of the surface layer by three sites in the circumferential direction with an optical microscope or an electron microscope, and the average value thereof was defined as the "film thickness" of the surface layer. The evaluation result is shown in Table 9.

<Evaluation 6-2. Measurement of Volume Resistivity of Surface Layer>

The volume resistivity of the surface layer was measured using an atomic force microscope (AFM) (Q-scope 250: Quesant) in an electroconductive mode. First, a sheet having a width of 2 mm and a length of 2 mm was cut out of the surface layer of the electroconductive roller using a manipulator. It should be noted that the cutting of the sheet out of the surface layer was performed so that one surface of the sheet included the surface of the surface layer. Next, platinum was deposited from the vapor onto outer-surface-side of the surface of the sheet so as to have a thickness of 80 nm. Next, the surface onto which platinum had been deposited from the vapor was connected to a DC power source (6614C: Agilent) and a voltage of 10 V was applied. The free end of a cantilever was brought into contact with the other surface of the surface layer, and a current image was obtained through the main body of the AFM. Current values at randomly selected 100 sites in the surface were measured, and a "volume resistivity" was calculated from an average current value of the ten lowest current values and the film thickness measured in the section 6-1. Conditions for the measurement are shown below. The evaluation result is shown as "Volume resistivity" in Table 9.

[Conditions for Measurement]

Measurement mode: contact

Cantilever: CSC17

Measurement range: 10 nm×10 nm

Scan rate: 4 Hz

Applied voltage: 10 V.

<Evaluation 6-3. Measurement of Universal Hardness of Surface Layer>

The universal hardness of the surface layer at a depth of 1 μm from the surface thereof was measured with a universal hardness tester.

An ultra-micro hardness tester (trade name: FISCHERSCOPE HM-2000, manufactured by Helmut Fischer) was used for the measurement. Specific measurement conditions are shown below.

Indenter for measurement: Vickers indenter, face angle 136°, Young's Module 1140, Poisson ratio 0.07.

Material for indenter: diamond

Measurement environment: temperature: 23° C., relative humidity: 50%

Maximum test load: 1.0 mN

Load condition: A load was applied in proportion to time at such a rate as to reach the maximum test load in 30 seconds.

In addition, in this evaluation, a load F when the indenter is driven to a depth of 1 μm from the surface of the surface layer, and a contact area A between the indenter and the surface layer at that time are used to calculate the universal hardness from the following equation (1).

$$\text{Universal hardness}(N/\text{mm}^2)=F/A \qquad \text{Equation (1)}$$

The measurement result is shown in Table 9.

<Evaluation 6-4. Martens Hardness of Surface Layer at Protruded Portion Derived from Roughening Particles>

The Martens hardness of the surface of the surface layer at a protruded portion derived from the roughening particles was measured using a universal hardness tester. Specifically, an ultra-micro hardness tester (trade name: PICODENTOR HM-500, manufactured by Helmut Fischer) was used.

Conditions for the measurement are shown below.

Indenter for measurement: Vickers indenter, face angle 136°, Young's Module 1140, Poisson ratio 0.07.

Material for indenter: diamond

Measurement environment: temperature: 23° C., relative humidity: 50%

Load rate and unload rate: 1 mN/50 s

In this evaluation, the tip of the indenter is brought into abutment with the protruded portion derived from the roughening particles on the surface of the member for electrophotography, and a load is applied at the speed described in the above-mentioned conditions. When the load reaches 0.04 mN, an indentation depth h is then determined, followed by the calculation of the Martens hardness from the following equation (2).

$$\text{Martens hardness } HM(N/\text{mm}^2)=F(N)/\text{surface area of indenter under test load } (\text{mm}^2) \qquad \text{Equation (2)}$$

The measurement result is shown in Table 9.

<Evaluation 6-5. Measurement of Surface Roughness>

The arithmetic average roughness Ra of the surface of the electroconductive roller was measured. The measurement was performed based on JIS B0601:1982 using a surface roughness measuring instrument (trade name: Surfcorder SE3400, manufactured by Kosaka Laboratory Ltd.). A contact needle made of diamond having a tip radius of 2 μm was used for the measurement. A measurement speed was set to 0.5 mm/s, a cutoff frequency λc was set to 0.8 mm, a reference length was set to 0.8 mm, and an evaluation length was set to 8.0 mm. In the measurement, a roughness curve was measured and a value of Ra was calculated at each of a total of nine sites in the surface, i.e., three sites in an axial direction by three sites in a circumferential direction for each electroconductive roller. The average value of those nine values of Ra was determined and defined as the value of Ra of the charging roller. The evaluation result is shown in Table 9.

<Evaluation 6-6. Measurement of Protruded Portions Derived from Exposed Portions of Electroconductive Fine Particles on Surface of Surface Layer>

A measurement method for the number of the protruded portions derived from the exposed portions of the electroconductive fine particles on the surface of the surface layer of the electroconductive roller is as described below. First, the elastic layer including the surface layer was cut out of the electroconductive roller, platinum was deposited from the vapor onto the outermost surface of the surface layer, and a region measuring 2.0 μm long by 2.0 μm wide was observed and photographed at a magnification of 40,000 using a scanning electron microscope (trade name: S-4800, manufactured by Hitachi High-Technologies Corporation). The resultant image was analyzed using image analysis software (trade name: Image-Pro Plus, manufactured by Planetron, Inc.). The taken SEM image was subjected to binarization processing, and the number of protruded portions was calculated. Five SEM images were taken, the average value of the calculated numbers of particles was defined as the number of fine protruded portions of the present invention. The evaluation result is shown in Table 9.

7. Image Evaluation

<Evaluation 7-1. Evaluation Test for Contamination>

A laser beam printer (trade name: HP LaserJet P1505 Printer, manufactured by HP) was prepared as an electrophotographic apparatus. The laser beam printer can output A4-size paper in a longitudinal direction. In addition, the laser printer has a print speed of 23 sheets/min and an image resolution of 600 dpi. A charging roller included with a process cartridge for the laser beam printer (trade name: "HP 36A (CB436A)", manufactured by HP) was removed, and the electroconductive roller 1 was incorporated as a charging roller. Then, the process cartridge was mounted onto the laser beam printer.

The laser beam printer was used to output an image in which an alphabetical letter "E" having a size of 4 points was printed at a print percentage of 1% on 2,000 sheets of A4-size paper under a low-temperature and low-humidity (temperature: 15° C., relative humidity: 10%) environment. It should be noted that the output of the electrophotographic image was performed in the so-called intermittent mode involving stopping the rotation of the electrophotographic photosensitive member over 7 seconds every time the image was output on one sheet. As compared to the case of continuously outputting electrophotographic images, the image output in the intermittent mode has a larger number of times of sliding between the charging roller and the electrophotographic photosensitive member, and hence can be said to be a more severe evaluation condition for the charging roller.

Figure 4:
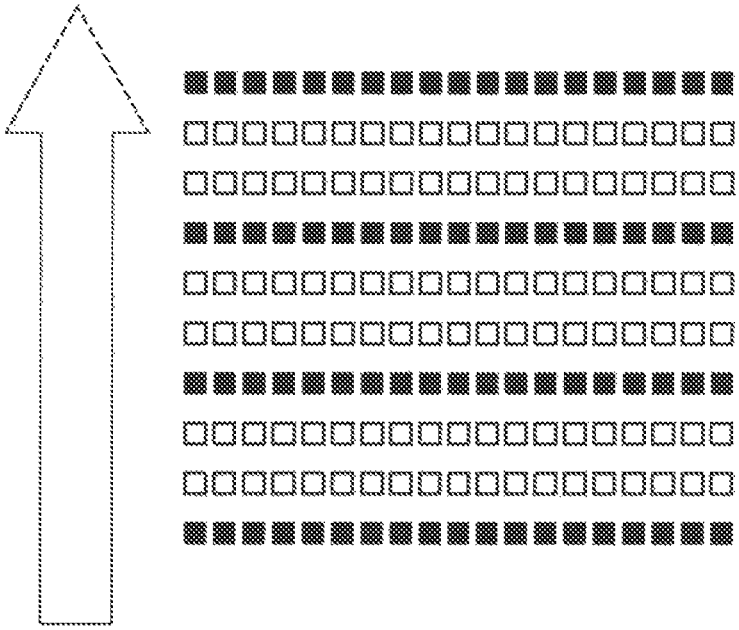
FIG. 4 is an explanatory view of a halftone image.

After the completion of such image output on 2,000 sheets, a halftone image (in which lines having a width of 1 dot are drawn in a direction perpendicular to the rotation direction of the photosensitive member at 2 dots interval as shown in FIG. 4) was output, and the resultant image was evaluated by the following criteria. The arrow in FIG. 4 represents the rotation direction of the photosensitive member. The evaluation result is shown in Table 9.

A: Charging unevenness due to the sticking of toner or an external additive to the surface of the charging roller cannot be found on the output image.

B: Charging unevenness due to the sticking of toner or an external additive to unevenness or a streak portion in the coating of the surface of the charging roller can be hardly found on the output image.

C: Charging unevenness due to the sticking of toner or an external additive to unevenness or a streak portion in the coating of the surface of the charging roller can be found on the output image.

D: Charging unevenness due to the sticking of toner or an external additive to unevenness or a streak portion in the coating of the surface of the charging roller can be found on the output image, and the degree of the charging unevenness is large. Specifically, white vertical streak-like charging unevenness can be found.

<Evaluation 7-2. Evaluation Test for Discharge Characteristic>

In the same manner as in "Evaluation 7-1" described above, an image was formed on 2,000 sheets under a low-temperature and low-humidity environment, and then a halftone image was output. The resultant image was evaluated by the following criteria. The evaluation result is shown in Table 9.

A: No white spot is found by visual observation on the output image.

B: A white spot is slightly found on the output image.

C: White spots are found across the entirety of the output image.

<Evaluation 7-3. Evaluation Test for Stable Chargeability under High Temperature and High Humidity>

A charging roller included with a process cartridge (trade name: "HP 36A (CB436A)", manufactured by HP) was removed, and the electroconductive roller 1 was incorporated as a charging roller. In addition, a surface potential gauge probe (trade name: MODEL 555P-1, manufactured by Trek Japan KK) was placed at a position rotated by 90° from the position of the charging roller in the circumferential direction of a photosensitive member, the position being away from the photosensitive member by 2 mm. The process cartridge was mounted onto a laser beam printer (trade name: HP LaserJet P1505 Printer, manufactured by HP). A surface potential (charge amount) at a position away from the central portion of the photosensitive member drum by 90 mm was measured under the following conditions: the rotation speed of the photosensitive member drum was halved and a voltage of DC-500 V was applied to the charging roller under a high-temperature and high-humidity (temperature: 30° C., relative humidity: 80%) environment. The evaluation result is shown in Table 9.

It should be noted that the value of the surface potential in this measurement is a measurement result at DC-500 V, which is a condition under which the charging roller does not discharge. The charge amount evaluated in this case is a charge amount to be added to the photosensitive member by a cause other than a discharge. Accordingly, as the value of the charge amount in this measurement increases, it becomes more difficult to control the surface potential of the photosensitive member during actual image output. This phenomenon is remarkable particularly under a high-temperature and high-humidity environment. In this evaluation, a target stable charge amount for maintaining output at a stable image density is 50 V or less.

<Evaluation 7-4. Evaluation Test for Contamination (Cleaner-less)>

The electroconductive roller 1 was set as a charging roller into a process cartridge (trade name: "HP 36A (CB436A)", manufactured by HP) from which a charging roller and a cleaning blade included therewith had been removed. In addition, a gear was attached to the charging roller so that the charging roller was rotated with a circumferential speed difference of 110% in a forward direction with respect to the rotation of the photosensitive member. The process cartridge was mounted onto a laser beam printer (trade name: HP LaserJet P1505 Printer, manufactured by HP), and an image in which horizontal lines each having a width of 2 dots were drawn at an interval of 100 dots in a direction perpendicular to the rotation direction of the photosensitive member was output on 100 sheets. Then, the charging roller was removed from the process cartridge, and its state of contamination was evaluated by tape coloration evaluation.

The tape coloration evaluation was performed as described below. A polyester pressure-sensitive adhesive tape (trade name: No. 31B, manufactured by Nitto Denko Corporation) was attached to the surface of the charging roller, and then the pressure-sensitive adhesive tape was peeled off together with toner adhering to the surface of the charging roller and was attached to white paper. This operation was performed for the entire image printing region of the surface of the charging roller. After that, the reflection density of the pressure-sensitive adhesive tape was measured for the entire image printing region with a Photovolt reflection densitometer (trade name: TC-6DS/A, manufactured by Tokyo Denshoku Co., Ltd.), and the maximum value was determined. Next, similarly, the reflection density of a fresh polyester pressure-sensitive adhesive tape attached to white paper was measured and the minimum value was determined. The increase in reflection density was defined as the value of a coloration density. As the value of the coloration density decreases, the contamination amount of the charging roller becomes smaller and more satisfactory. Accordingly, the value of the coloration density was adopted as an indicator of the degree of contamination of the charging roller. The evaluation result is shown in Table 9.

<Evaluation 7-5. Evaluation Test for HH Stable Chargeability (Cleaner-less)>

In the same manner as in the case of Evaluation 7-4 described above, an evaluation test for stable chargeability under high temperature and high humidity in the case where the charging roller was rotated with a circumferential speed difference with respect to the photosensitive member drum was performed by the same technique as that of "Evaluation 7-3" described above.

A charging roller and a cleaning blade included with a process cartridge (trade name: "HP 36A (CB436A)", manufactured by HP) were removed, and the electroconductive roller 1 was incorporated as a charging roller. In addition, a surface potential gauge probe (trade name: MODEL 555P-1, manufactured by Trek Japan KK) was placed at a position rotated by 90° from the position of the charging roller in the circumferential direction of a photosensitive member drum, the position being away from the photosensitive member drum by 2 mm. The process cartridge was mounted onto a laser beam printer (trade name: HP LaserJet P1505 Printer, manufactured by HP). A surface potential (charge amount) at the central portion of the photosensitive member drum in the case where a voltage of DC-500 V was applied to the charging roller was measured. The evaluation result is shown in Table 9.

Examples 2 to 27

Electroconductive rollers 2 to 27 were produced and evaluated in the same manner as in Example 1 except that the coating liquid 1 was changed to respective coating liquids shown in Table 4. It should be noted that (A) hydroxy group-terminated prepolymers (polyols), (B) isocyanate group-terminated prepolymers (isocyanates), (C) roughening particles, and (D) silicone additives serving as raw materials for the coating liquids shown in Table 4 are shown in Table 3. As some of the isocyanate group-terminated prepolymers, in the same manner as in Example 1, products each obtained by subjecting a polyol and polymeric MDI (trade name: MILLIONATE MR200, manufactured by Nippon Polyurethane Industry Co., Ltd.) to a reaction in advance as shown in Table 4 and having an isocyanate group content adjusted to 4.3% were used. The evaluation results are shown in Table 9.

TABLE 3

| | |
|---|---|
| | Hydroxy group-terminated prepolymer |
| A-1 | Polyester polyol<br>(P2010, manufactured by Kuraray Co., Ltd.) |
| A-2 | Polycarbonate-based polyol<br>(T5652, manufactured by Asahi Kasei Chemicals Corp.) |
| A-3 | Castor oil<br>(URIC-H1823, manufactured by Itoh Oil Chemicals Co., Ltd.) |
| A-4 | Polyolefin polyol<br>(G2000, manufactured by Idemitsu Kosan Co., Ltd.) |
| A-5 | Polyether polyol<br>(EXCENOL 3020, manufactured by Asahi Glass Co., Ltd.) |
| A-6 | Acrylic polyol<br>(DC2016, manufactured by Daicel Chemical Industries, Ltd.) |
| | Isocyanate-terminated prepolymer |
| B-1 | Polyester polyol/polymeric MDI<br>(P3010, manufactured by Kuraray Co., Ltd./MILLIONATE MR200, manufactured by Nippon Polyurethane Industry Co., Ltd.) |
| B-2 | Polycarbonate-based polyol/polymeric MDI<br>(T5652, manufactured by Asahi Kasei Chemicals Corp./MILLIONATE MR200, manufactured by Nippon Polyurethane Industry Co., Ltd.) |
| B-3 | Polyester-based polyol/polymeric MDI<br>(P2050, manufactured by Kuraray Co., Ltd./MILLIONATE MR200, manufactured by Nippon Polyurethane Industry Co., Ltd.) |
| B-4 | Polyolefin polyol/polymeric MDI<br>(G2000, manufactured by Idemitsu Kosan Co., Ltd./MILLIONATE MR200, manufactured by Nippon Polyurethane Industry Co., Ltd.) |
| B-5 | Polypropylene glycol-based polyol/polymeric MDI<br>(EXCENOL 1030, manufactured by Asahi Kasei Corp./MILLIONATE MR200, manufactured by Nippon Polyurethane Industry Co., Ltd.) |
| B-6 | Isocyanate A/isocyanate B = 4/3<br>(VESTANAT B1370, manufactured by Degussa AG/DURANATE TPA-B80E, manufactured by Asahi Kasei Chemicals Corp.) |
| | Roughening particles |
| C-1 | DAIMICBEAZ UCN-5070D<br>(average particle diameter: 7.0 μm, manufactured by Dainichiseika Color & Chemicals Mfg. Co., Ltd.) |
| C-2 | DAIMICBEAZ UCN-5150D<br>(average particle diameter: 15.0 μm, manufactured by Dainichiseika Color & Chemicals Mfg. Co., Ltd.) |
| C-3 | Art-pearl JB-600T<br>(average particle diameter: 10.0 μm, manufactured by Negami Chemical Industrial Co., Ltd.) |
| C-4 | Techpolymer MBX-8<br>(average particle diameter: 8.0 μm, manufactured by Sekisui Plastics Co., Ltd.) |

TABLE 3-continued

| Silicone additive | |
|---|---|
| D-1 | Modified dimethylsilicone oil (trade name: SH-28PA, manufactured by Dow Corning Toray Silicone Co., Ltd.) |
| D-2 | Silicone-modified acrylic resin (trade name: SQ-100, manufactured by TOKUSHIKI Co., Ltd.) |

TABLE 4

| | Coating liquid 1 | Coating liquid 2 | Coating liquid 3 | Coating liquid 4 | Coating liquid 5 | Coating liquid 6 | Coating liquid 7 |
|---|---|---|---|---|---|---|---|
| Polyol | A-1 | A-1 | A-1 | A-1 | A-1 | A-1 | A-1 |
| Isocyanate | B-1 | B-1 | B-1 | B-1 | B-1 | B-1 | B-1 |
| A/B addition amount | 43/57 | 43/57 | 43/57 | 43/57 | 43/57 | 43/57 | 43/57 |
| Roughening particles | C-1 | C-1 | C-1 | — | C-2 | C-3 | C-4 |
| Addition amount (phr) | 15 | 30 | 45 | — | 30 | 30 | 30 |
| Silicone additive | — | — | — | — | — | — | — |
| Addition amount (phr) | — | — | — | — | — | — | — |
| CB addition amount (phr) | 23 | 23 | 23 | 23 | 23 | 23 | 23 |

| | Coating liquid 8 | Coating liquid 9 | Coating liquid 10 | Coating liquid 11 | Coating liquid 12 | Coating liquid 13 | Coating liquid 14 |
|---|---|---|---|---|---|---|---|
| Polyol | A-1 | A-1 | A-1 | A-1 | A-2 | A-2 | A-2 |
| Isocyanate | B-1 | B-1 | B-1 | B-1 | B-2 | B-2 | B-2 |
| A/B addition amount | 43/57 | 43/57 | 43/57 | 43/57 | 46/54 | 46/54 | 46/54 |
| Roughening particles | C-1 | C-1 | C-1 | C-1 | C-1 | C-1 | C-1 |
| Addition amount (phr) | 30 | 30 | 30 | 30 | 15 | 30 | 45 |
| Silicone additive | — | — | D-1 | D-2 | — | — | — |
| Addition amount (phr) | — | — | 0.1 | 0.1 | — | — | — |
| CB addition amount (phr) | 18 | 28 | 23 | 23 | 23 | 23 | 23 |

| | Coating liquid 15 | Coating liquid 16 | Coating liquid 17 | Coating liquid 18 | Coating liquid 19 | Coating liquid 20 | Coating liquid 21 |
|---|---|---|---|---|---|---|---|
| Polyol | A-2 | A-2 | A-2 | A-3 | A-4 | A-5 | A-6 |
| Isocyanate | B-2 | B-2 | B-2 | B-3 | B-4 | B-5 | B-6 |
| A/B addition amount | 46/54 | 46/54 | 46/54 | 52/48 | 43/57 | 59/41 | 41/59 |
| Roughening particles | — | C-1 | C-4 | C-1 | C-1 | C-1 | C-1 |
| Addition amount (phr) | — | 30 | 30 | 30 | 30 | 30 | 30 |
| Silicone additive | — | D-1 | — | — | — | — | — |
| Addition amount (phr) | — | 0.1 | — | — | — | — | — |
| CB addition amount (phr) | 23 | 23 | 23 | 25 | 30 | 23 | 23 |

Example 28

An electroconductive roller 28 was produced and evaluated in the same manner as in Example 1 except that a material shown in Table 5 below was used as a rubber material for the elastic layer and the coating liquid 1 was changed to the coating liquid 2. The evaluation results are shown in Table 9.

TABLE 5

| Material | Parts by mass |
|---|---|
| Epichlorohydrin-ethylene oxide-allyl glycidyl ether terpolymer (GECO) (trade name: EPION301, manufactured by Daiso Co., Ltd.) | 100.0 |

Example 29

Materials whose kinds and amounts were as shown in Table 6 below were mixed with a pressure kneader to provide an A kneaded rubber composition. Further, the A kneaded rubber composition and materials whose kinds and amounts were as shown in Table 7 below were mixed with an open roll to prepare an unvulcanized rubber composition. Then, a surface layer was formed using the coating liquid 2. In the same manner as in Example 1 except for the foregoing, an electroconductive roller 29 was produced and evaluated. The evaluation results are shown in Table 9.

TABLE 6

| | Material | Part(s) by mass |
|---|---|---|
| Raw material rubber | NBR (trade name: Nipol DN219, manufactured by Zeon Corporation) | 100 |
| Electroconductive agent | Carbon black (trade name: TOKABLACK #7360SB, manufactured by Tokai Carbon Co., Ltd.) | 40 |
| Filler | Calcium carbonate (trade name: Nanox #30, manufactured by Maruo Calcium Co., Ltd.) | 20 |
| Vulcanization accelerating aid | Zinc oxide | 5 |
| Processing aid | Stearic acid | 1 |

TABLE 7

| | Material | Parts by mass |
|---|---|---|
| Crosslinking agent | Sulfur | 1.2 |
| Vulcanization accelerator | Tetrabenzylthiuram disulfide (trade name: TBZTD, manufactured by Sanshin Chemical Industry Co., Ltd.) | 4.5 |

Example 30

Materials shown in Table 8 below were mixed to prepare an unvulcanized rubber composition. A mandrel (electroconductive support) which was a stainless-steel bar having an outer diameter ϕ of 6 mm and a length of 258 mm was placed in a die, and the unvulcanized rubber composition was injected into a cavity formed in the die.

TABLE 8

| Material | Part(s) by mass |
|---|---|
| Liquid silicone rubber (trade name: SE6724A/B, manufactured by Dow Corning Toray Co., Ltd.) | 100 |
| Carbon black (trade name: TOKABLACK #7360SB, manufactured by Tokai Carbon Co., Ltd.) | 28 |
| Silica powder | 0.2 |
| Platinum catalyst | 0.1 |

Next, the die was heated at 120° C. for 8 minutes, and then cooled to room temperature, followed by removal from the die. After that, the resultant was heated at 200° C. for 60 minutes to be vulcanized and cured, to thereby form an elastic layer having a thickness of 3.0 mm on the outer peripheral surface of the mandrel. After that, a surface layer was formed using the coating liquid 2. In the same manner as in Example 1 except for the foregoing, an electroconductive roller 30 was obtained. The evaluation results are shown in Table 9.

TABLE 9

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Electroconductive roller | | | | | | | | | | |
| Elastic layer | CG102 | CG102 | CG102 | CG102 | CG102 | CG102 | CG102 | CG102 | CG102 | CG102 |
| Surface layer | Coating liquid 1 | Coating liquid 2 | Coating liquid 3 | Coating liquid 4 | Coating liquid 5 | Coating liquid 6 | Coating liquid 7 | Coating liquid 2 | Coating liquid 2 | Coating liquid 8 |
| Film thickness | 20 | 20 | 20 | 20 | 20 | 20 | 20 | 10 | 40 | 20 |
| Surface treatment | UV | UV | UV | UV | UV | UV | UV | UV | UV | UV |
| UV integrated light quantity ($mJ/cm^2$) | 9,000 | 9,000 | 9,000 | 9,000 | 9,000 | 9,000 | 9,000 | 9,000 | 9,000 | 9,000 |
| Physical property evaluation | | | | | | | | | | |
| Ra (μm) | 1.41 | 1.67 | 1.81 | 0.83 | 2.53 | 2.11 | 1.97 | 1.75 | 1.52 | 1.43 |
| Universal hardness ($N/mm^2$) | 3.2 | 3.3 | 3.2 | 2.8 | 3.1 | 2.9 | 5.8 | 2.6 | 4.3 | 3.1 |

TABLE 9-continued

| | | | | | | | | | | |
|---|---|---|---|---|---|---|---|---|---|---|
| Martens hardness ($N/mm^2$) | 3.4 | 3.4 | 3.3 | — | 3.5 | 2.9 | 12.3 | 3.1 | 4.4 | 3.3 |
| Volume resistivity of surface layer (Ωcm) | 4.80E+10 | 6.10E+10 | 7.90E+10 | 3.70E+10 | 6.80E+10 | 5.30E+10 | 7.10E+10 | 6.10E+10 | 6.30E+10 | 1.30E+10 |
| Fine protruded portions (number) | 210 | 236 | 203 | 213 | 189 | 240 | 211 | 195 | 253 | 149 |
| Image evaluation | | | | | | | | | | |
| Contamination evaluation | A | A | B | A | C | A | B | A | A | A |
| HH stable chargeability evaluation (V) | 45 | 43 | 40 | 54 | 36 | 47 | 35 | 55 | 40 | 41 |
| White spot evaluation | A | A | A | B | A | A | A | A | A | A |
| Contamination evaluation (CLN-less) | 13.4 | 14.3 | 16.4 | 11.3 | 20.6 | 13.4 | 32.8 | 15.1 | 20.2 | 17.2 |
| HH stable chargeability evaluation (CLN-less) (V) | 47 | 44 | 41 | 55 | 38 | 48 | 36 | 55 | 42 | 41 |

| | Example 11 | Example 12 | Example 13 | Example 14 | Example 15 | Example 16 | Example 17 | Example 18 | Example 19 | Example 20 |
|---|---|---|---|---|---|---|---|---|---|---|
| Electroconductive roller | | | | | | | | | | |
| Elastic layer | CG102 | CG102 | CG102 | CG102 | CG102 | CG102 | CG102 | CG102 | CG102 | CG102 |
| Surface layer | Coating liquid 9 | Coating liquid 10 | Coating liquid 11 | Coating liquid 2 | Coating liquid 2 | Coating liquid 2 | Coating liquid 12 | Coating liquid 13 | Coating liquid 14 | Coating liquid 15 |
| Film thickness | 20 | 20 | 20 | 20 | 20 | 20 | 20 | 20 | 20 | 20 |
| Surface treatment | UV | UV | UV | UV | UV | Grinding | UV | UV | UV | UV |
| UV integrated light quantity ($mJ/cm^2$) | 9,000 | 9,000 | 9,000 | 3,000 | 18,000 | — | 9,000 | 9,000 | 9,000 | 9,000 |
| Physical property evaluation | | | | | | | | | | |
| Ra (μm) | 1.44 | 1.65 | 1.67 | 1.40 | 1.43 | 1.01 | 1.37 | 1.71 | 1.88 | 0.87 |
| Universal hardness ($N/mm^2$) | 3.4 | 2.9 | 3.1 | 3.3 | 3.1 | 3.1 | 3.4 | 3.4 | 3.5 | 3.1 |
| Martens hardness ($N/mm^2$) | 3.5 | 3.0 | 3.1 | 3.4 | 3.3 | 3.3 | 3.5 | 3.5 | 3.5 | — |
| Volume resistivity of surface layer (Ωcm) | 9.20E+10 | 6.60E+10 | 6.50E+10 | 6.10E+10 | 4.90E+10 | 6.60E+10 | 2.30E+12 | 3.50E+12 | 4.10E+12 | 1.10E+12 |
| Fine protruded portions (number) | 511 | 211 | 222 | 231 | 219 | 208 | 207 | 233 | 215 | 244 |
| Image evaluation | | | | | | | | | | |
| Contamination evaluation | A | A | A | A | A | B | A | A | B | A |
| HH stable chargeability evaluation (V) | 45 | 41 | 42 | 41 | 45 | 47 | 37 | 32 | 30 | 42 |
| White spot evaluation | B | A | A | A | A | B | A | A | A | B |
| Contamination evaluation (CLN-less) | 18.1 | 10.5 | 11.8 | 17.2 | 13.9 | 21.4 | 7.9 | 9.2 | 10.5 | 5.0 |
| HH stable chargeability evaluation (CLN-less) (V) | 47 | 43 | 43 | 41 | 46 | 48 | 39 | 34 | 30 | 44 |

TABLE 9-continued

| | Example 21 | Example 22 | Example 23 | Example 24 | Example 25 | Example 26 | Example 27 | Example 28 | Example 29 | Example 30 |
|---|---|---|---|---|---|---|---|---|---|---|
| Electroconductive roller | | | | | | | | | | |
| Elastic layer | CG102 | CG102 | CG102 | CG102 | CG102 | CG102 | CG102 | Epion301 | NBR | Silicone |
| Surface layer | Coating liquid 16 | Coating liquid 17 | Coating liquid 13 | Coating liquid 18 | Coating liquid 18 | Coating liquid 19 | Coating liquid 19 | Coating liquid 2 | Coating liquid 2 | Coating liquid 2 |
| Film thickness | 20 | 20 | 20 | 20 | 20 | 20 | 20 | 20 | 20 | 20 |
| Surface treatment | UV | UV | UV | UV | UV | UV | UV | UV | UV | UV |
| UV integrated light quantity ($mJ/cm^2$) | 9,000 | 9,000 | 3,000 | 9,000 | 3,000 | 9,000 | 3,000 | 9,000 | 9,000 | 9,000 |
| Physical property evaluation | | | | | | | | | | |
| Ra (μm) | 1.70 | 1.89 | 1.72 | 1.69 | 1.70 | 1.71 | 1.73 | 1.68 | 1.67 | 1.63 |
| Universal hardness ($N/mm^2$) | 3.2 | 6.1 | 3.3 | 4.8 | 4.7 | 4.1 | 4.0 | 3.2 | 6.3 | 2.1 |
| Martens hardness ($N/mm^2$) | 3.3 | 12.5 | 3.4 | 4.6 | 4.5 | 4.0 | 4.0 | 3.4 | 6.4 | 2.3 |
| Volume resistivity of surface layer (Ωcm) | 4.30E+12 | 5.10E+12 | 4.30E+12 | 8.30E+13 | 8.20E+13 | 1.40E+14 | 1.50E+14 | 4.50E+10 | 4.60E+10 | 4.30E+10 |
| Fine protruded portions (number) | 183 | 201 | 255 | 237 | 219 | 205 | 226 | 199 | 31 | 49 |
| Image evaluation | | | | | | | | | | |
| Contamination evaluation | A | B | A | A | A | A | A | A | C | C |
| HH stable chargeability evaluation (V) | 35 | 31 | 33 | 31 | 33 | 28 | 27 | 54 | 36 | 33 |
| White spot evaluation | A | A | A | A | A | A | A | A | C | C |
| Contamination evaluation (CLN-less) | 4.6 | 27.7 | 9.7 | 10.9 | 10.8 | 10.1 | 10.1 | 14.7 | 27.7 | 30.7 |
| HH stable chargeability evaluation (CLN-less) (V) | 36 | 32 | 34 | 32 | 33 | 28 | 29 | 54 | 37 | 35 |

Comparative Example 1

A surface layer was formed using the coating liquid 14 and irradiation with UV light was not performed. An electroconductive roller 31 was produced in the same manner as in Example 1 except for the foregoing, and evaluated in the same manner as in Example 1. It should be noted that the protruded portions derived from the exposed electroconductive fine particles are not present on the surface of this surface layer, and hence the conditions of the present invention are not satisfied. The evaluation results are shown in Table 10.

Comparative Example 2

An electroconductive roller 32 was produced in the same manner as in Example 1 except for using the coating liquid as a coating liquid for a surface layer, and was evaluated in the same manner as in Example 1. It should be noted that the volume resistivity of the surface of this surface layer is low, and hence the conditions of the present invention are not satisfied. The evaluation results are shown in Table 10.

Comparative Example 3

An electroconductive roller 33 was produced in the same manner as in Example 1 except for using the coating liquid as a coating liquid for a surface layer, and was evaluated in the same manner as in Example 1. It should be noted that the universal hardness of the surface of this surface layer is high, and hence the conditions of the present invention are not satisfied. The evaluation results are shown in Table 10.

TABLE 10

| | Comparative Example 1 | Comparative Example 2 | Comparative Example 3 |
|---|---|---|---|
| Electroconductive roller | | | |
| Elastic layer | CG102 | CG102 | CG102 |
| Surface layer | Coating liquid 14 | Coating liquid 20 | Coating liquid 21 |
| Film thickness | 20 | 20 | 20 |
| Surface treatment | — | UV | UV |
| UV integrated light quantity ($mJ/cm^2$) | — | 9,000 | 9,000 |
| Physical property evaluation | | | |
| Ra (μm) | 1.67 | 1.68 | 1.65 |
| Universal hardness ($N/mm^2$) | 3.1 | 2.5 | 18.1 |
| Martens hardness ($N/mm^2$) | 3.6 | 3.1 | 15.2 |
| Volume resistivity of surface layer (Ωcm) | 4.40E+10 | 3.30E+09 | 1.50E+12 |
| Fine protruded portions (number) | — | 217 | 208 |

TABLE 10-continued

| | Comparative Example 1 | Comparative Example 2 | Comparative Example 3 |
|---|---|---|---|
| Image evaluation | | | |
| Contamination evaluation | D | B | B |
| HH stable chargeability evaluation (V) | 38 | 145 | 30 |
| White spot evaluation | A | A | A |
| Contamination evaluation (CLN-less) | 71.4 | 29.4 | 67.2 |
| HH stable chargeability evaluation (CLN-less) (V) | 39 | 150 | 30 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242406, filed Nov. 28, 2014, which is hereby incorporated by reference herein in its entirety.

What is claimed is:

1. An electroconductive member for electrophotography, comprising, in this order:

an electroconductive support;

an electroconductive elastic layer; and a surface layer comprising a binder resin with electroconductive fine particles dispersed in the binder resin, said electroconductive fine particles having a number average particle diameter of 5.0 to 50.0 nm, wherein at least part of the electroconductive fine particles are exposed from the surface layer, the surface layer has, on a surface thereof, protruded portions derived from exposed portions of the electroconductive fine particles, the surface layer has a volume resistivity of $1.0\times10^{10}$ to $1.0\times10^{16}$ Ω·cm, and the surface layer has a universal hardness at a depth of 1 μm from the surface thereof of 1.0 to 7.0 N/mm$^2$.

2. An electroconductive member for electrophotography according to claim 1, wherein when a region measuring 2.0 μm long by 2.0 μm wide in the surface of the surface layer is observed using a scanning electron microscope, a number of the exposed portions of the electroconductive fine particles in the region is 50 to 500.

3. An electroconductive member for electrophotography according to claim 1, wherein the electroconductive fine particles comprise carbon black.

4. An electroconductive member for electrophotography according to claim 1, wherein the surface layer contains roughening particles having a number average particle diameter of 3 to 30 μm, has on the surface thereof a protruded portion derived from the roughening particles, and has a Martens hardness at the protruded portion of 10.0 N/mm$^2$ or less when a load reaches 0.04 mN.

5. An electroconductive member for electrophotography according to claim 1, wherein the binder resin has a polycarbonate structure.

6. An electroconductive member for electrophotography according to claim 1, wherein the protruded portions derived from the exposed portions of the electroconductive fine particles of the surface layer comprise protruded portions formed by UV treatment.

7. An electroconductive member for electrophotography according to claim 1, wherein the surface layer has a thickness of 0.1 to 100 μm.

8. An electroconductive member for electrophotography according to claim 7, wherein the surface layer has a thickness of 1 to 50 μm.

9. A process cartridge, comprising:

an electrophotographic photosensitive member; and a charging member arranged in contact with the electrophotographic photosensitive member;

the process cartridge being removably mounted onto a main body of an electrophotographic image-forming apparatus, wherein the charging member comprises in this order:

an electroconductive support;

an electroconductive elastic layer; and a surface layer comprising a binder resin with electroconductive fine particles dispersed in the binder resin, said electroconductive fine particles having a number average particle diameter of 5.0 to 50.0 nm, wherein at least part of the electroconductive fine particles are exposed from the surface layer, the surface layer has, on a surface thereof, protruded portions derived from exposed portions of the electroconductive fine particles, the surface layer has a volume resistivity of $1.0\times10^{10}$ to $1.0\times10^{16}$ Ω·cm, and the surface layer has a universal hardness at a depth of 1 μm from the surface thereof of 1.0 to 7.0 N/mm$^2$.

10. An electrophotographic image-forming apparatus, comprising:

an electrophotographic photosensitive member; and a charging member arranged in contact with the electrophotographic photosensitive member, wherein the charging member comprises, in this order:

an electroconductive support;

an electroconductive elastic layer; and a surface layer comprising a binder resin with electroconductive fine particles dispersed in the binder resin, said electroconductive fine particles having a number average particle diameter of 5.0 to 50.0 nm, wherein at least part of the electroconductive fine particles are exposed from the surface layer, the surface layer has, on a surface thereof, protruded portions derived from exposed portions of the electroconductive fine particles, the surface layer has a volume resistivity of $1.0\times10^{10}$ to $1.0\times10^{16}$ Ω·cm, and the surface layer has a universal hardness at a depth of 1 μm from the surface thereof of 1.0 to 7.0 N/mm$^2$.

11. An electrophotographic image-forming apparatus according to claim 10, wherein the charging member is configured to move at a different speed from that of the electrophotographic photosensitive member.

* * * * *